United States Patent [19]

Bradbury

[11] Patent Number: 5,011,812

[45] Date of Patent: Apr. 30, 1991

[54] THERMAL TRANSFER PRINTING

[75] Inventor: Roy Bradbury, Cheshire, England

[73] Assignee: Imperial Chemical Industries, London, England

[21] Appl. No.: 381,260

[22] Filed: Jul. 18, 1989

[30] Foreign Application Priority Data

Jul. 20, 1988 [GB] United Kingdom ..... 8817220

[51] Int. Cl.[5] ..... B41M 5/035; B41M 5/26

[52] U.S. Cl. ..... 503/227; 8/471; 428/195; 428/211; 428/474.4; 428/480; 428/500; 428/913; 428/914

[58] Field of Search ..... 8/471; 428/195, 480, 428/913, 914, 211, 474.4, 500; 503/227

[56] References Cited

U.S. PATENT DOCUMENTS 4,859,651 8/1989 Gregory et al. ..... 503/227

*Primary Examiner*—Bruce H. Hess

*Attorney, Agent, or Firm*—Cushman, Darby & Cushman

[57] ABSTRACT

A thermal transfer printing sheet comprising a substrate having a coating comprising a binder and a water insoluble dye of Formula I:

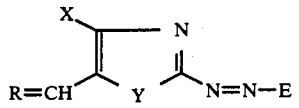

I wherein;

R is the residue of an active methylene compound;

X is hydrogen; halogen; optionally substituted alkyl; optionally substituted aryl or optionally substituted heteroaryl;

Y is —S— or a group of the formula N—$R^1$ wherein $R^1$ represents hydrogen or an optionally substituted $C_{1-4}$-alkyl; and E is the residue of a coupling component.

The dyes are suitable for use in dye diffusion thermal transfer printing of the type where a transfer sheet is placed in contact with the material to be printed and selectively heated in accordance with a pattern information signal whereby dye from the selectively heated regions of the transfer sheet is transferred to the material to be printed and forms a pattern thereon the shape and density of which is in accordance with the pattern and intensity of heat applied to the transfer sheet.

17 Claims, No Drawings

THERMAL TRANSFER PRINTING

INTRODUCTION

This specification describes an invention relating to dye diffusion thermal transfer printing (DDTTP), especially to a DDTTP sheet carrying a dye or dye mixture, to the transfer printing process, to the preparation of the DDTTP sheet, to the dye mixture and to a novel dye.

In DDTTP a heat-transferable dye is applied to a sheet-like substrate in the form of an ink, usually containing a polymeric or resinous binder to bind the dye to the substrate, to form a transfer sheet. This is then placed in contact with the material to be printed, (generally a film of polymeric material such as a polyester sheet) hereinafter called the receiver sheet and selectively heated in accordance with a pattern information signal whereby dye from the selectively heated regions of the transfer sheet is transferred to the receiver sheet and forms a pattern thereon in accordance with the pattern of heat applied to the transfer sheet.

Important criteria in the selection of a dye for DDTTP are its thermal properties, brightness of shade, fastness properties, such as light fastness, and facility for application to the substrate in the preparation of the transfer sheet. For suitable performance the dye should transfer evenly, in proportion to the heat applied to the DDTTP sheet so that the depth of shade on the receiver sheet is proportional to the heat applied and a true grey scale of coloration can be achieved on the receiver sheet. Brightness of shade is important in order to achieve as wide a range of shades with the three primary dye shades of yellow, magenta and cyan. As the dye must be sufficiently mobile to migrate from the transfer sheet to the receiver sheet at the temperatures employed, 300°–400° C., it is generally free from ionic and water-solubilising groups, and is thus not readily soluble in aqueous or water-miscible media, such as water and ethanol. Many suitable dyes are also not readily soluble in the hydrocarbon solvents which are commonly used in, and thus acceptable to, the printing industry; for example, alcohols such as i-propanol, ketones such as methyl-ethylketone (MEK), methyl-i-butylketone (MIBK) and cyclohexanone, ethers such as tetrahydrofuran and aromatic hydrocarbons such as toluene. Although the dye can be applied as a dispersion in a suitable solvent, it has been found that brighter, glossier and smoother final prints can be achieved on the receiver sheet if the dye is applied to the substrate from a solution. In order to achieve the potential for a deep shade on the receiver sheet it is desirable that the dye should be readily soluble in the ink medium. It is also important that a dye which has been applied to a transfer sheet from a solution should be resistant to crystallisation so that it remains as an amorphous layer on the transfer sheet for a considerable time.

The following combination of properties are highly desirable for a dye which is to be used in DDTTP:

Ideal spectral characteristics (narrow absorption curve with absorption maximum matching a photographic filter).

High tinctorial strength (extinction coefficient >40,000).

Correct thermochemical properties (high thermal stability and good transferability with heat).

High optical densities on printing.

Good solubility in solvents acceptable to printing industry: this is desirable to produce solution coated dyesheets.

Stable dyesheets (resistant to dye migration or crystallisation).

Stable printed images on the receiver sheet (to heat, migration, crystallisation, grease, rubbing and light).

The achievement of good light fastness in DDTTP is extremely difficult because of the unfavourable environment of the dye, namely surface printed polyester on a white pigmented base. Many known dyes for polyester fibre with high light fastness (>6 on the International Scale of 1–8) on polyester fibre exhibit very poor light fastness (<3) in DDTTP.

It has now been found that certain monoazo dyes derived from aminothiazoles and aminoimidazoles provide desirable magenta to cyan shades having high light fastness and good optical density and are thermally stable.

THE INVENTION

According to a first aspect of the present invention there is provided a thermal transfer printing sheet comprising a substrate having a coating comprising a binder and a water-insoluble dye of the formula:

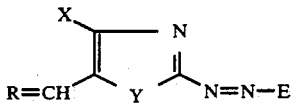

I wherein

R represents the residue of an active methylene compound;

X represents hydrogen; halogen; optionally substituted alkyl, optionally substituted aryl or optionally substituted heteroaryl radical;

Y represents -S- or a group of the formula N—$R^1$ wherein $R^1$ represents hydrogen or an optionally substituted $C_{1-4}$-alkyl radical; and E represents the residue of a coupling component.

The Coating

The coating preferably comprises a binder and one or more dyes of Formula I. The ratio of binder to dye is preferably at least 1:1 and more preferably from 1.5:1 to 4:1 in order to provide good adhesion between the dye and the substrate and inhibit migration of the dye during storage.

The coating may also contain other additives, such as curing agents, preservatives, etc., these and other ingredients being described more fully in EP 133011A, EP 133012A and EP 111004A.

The Binder

The binder may be any resinous or polymeric material suitable for binding the dye to the substrate which has acceptable solubility in the ink medium, i.e. the medium in which the dye and binder are applied to the transfer sheet. Examples of binders include cellulose derivatives, such as ethylhydroxyethylcellulose (EHEC), hydroxypropylcellulose (HPC), ethylcellulose, methyl- cellulose, cellulose acetate and cellulose acetate butyrate; carbohydrate derivatives, such as starch; alginic acid derivatives; alkyd resins; vinyl resins and derivatives, such as polyvinyl alcohol, polyvinyl acetate, polyvinyl butyral and polyvinyl pyrrolidone;

polymers and co-polymers derived from acrylates and acrylate derivatives, such as polyacrylic acid, polymethyl methacrylate and styrene-acrylate copolymers, polyester resins, polyamide resins, such as melamines; polyurea and polyurethane resins; organosilicones, such as polysiloxanes, epoxy resins and natural resins, such as gum tragacanth and gum arabic. Mixtures of two or more of the above binders may be used.

It is however preferred to use a binder which is soluble in one of the above-mentioned commercially acceptable organic solvents. Preferred binders of this type are EHEC, particularly the low and extra-low viscosity grades, and ethyl cellulose.

The Dye of Formula I

In the dyes of Formula I, the residue of an active methylene group represented by R may be, for example, a group of the Formula II:

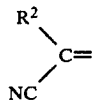

II wherein $R^2$ represents cyano; acetyl; optionally substituted $C_{1-10}$-alkoxycarbonyl; optionally substituted $C_{3-8}$-alkenyloxycarbonyl; $C_{1-4}$-alkylsulphonyl; phenylsulphonyl; optionally substituted aminocarbonyl; optionally substituted $C_{1-4}$-alkylaminocarbonyl; optionally substituted di($C_{1-4}$-alkyl)aminocarbonyl; optionally substituted phenyl or optionally substituted benzoyl.

Residues of coupling components represented by E particularly include radicals of the Formula III:

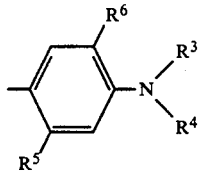

III wherein each of $R^3$ and $R^4$, independently, represents hydrogen or an optionally substituted $C_{1-4}$-alkyl, $C_{4-8}$-cycloalkyl, $C_{3-4}$-alkenyl, phenyl-$C_{1-4}$-alkyl or phenyl radical, $R^5$ represents hydrogen, halogen, especially chlorine or bromine, $C_{1-4}$-alkyl, $C_{1-4}$-alkoxy, $C_{1-4}$-alkylthio, $C_{1-4}$-alkylcarbonylamino, phenylcarbonylamino or $C_{1-4}$-alkylsulphonylamino and $R^6$ represents hydrogen, $C_{1-4}$-alkyl or $C_{1-4}$-alkoxy.

It is especially preferred that E is a group of the Formula IV:

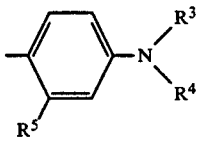

IV wherein $R^3$ & $R^4$ are independently selected from H, $C_{1-4}$-alkyl, aryl, $C_{4-8}$-cycloalkyl and $C_{1-4}$-alkyl substituted by a group selected from OH, CN, halogen, phenyl, $C_{1-4}$-alkoxy, $C_{1-4}$-alkoxy-$C_{1-4}$-alkoxy, $C_{1-4}$-alkylCO-, $C_{1-4}$-alkoxyCO-, $C_{1-4}$-alkyl-COO-, $C_{1-4}$-alkoxy-$C_{1-4}$-alkoxy-CO-, $C_{1-4}$-alkoxy-COO- and $C_{1-4}$-alkoxy-$C_{1-4}$-alkyl-COO-; and $R^5$ is selected from H, $C_{1-4}$-alkyl, cyano-$C_{1-4}$-alkyl, $C_{1-4}$-alkoxy and -NHCOT$^1$.

wherein $T^1$ is $C_{1-4}$-alkyl or phenyl.

Some of the dyes of Formula I and methods for their preparation have been described in GB-A-2071684. Dyes of Formula I not described in that publication may be prepared by analogous methods.

A preferred sub-class of dyes according to the present invention conform to the Formula V:

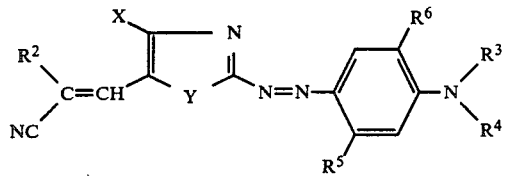

V wherein:

$R^2$ represents cyano; acetyl and optionally substituted $C_{1-6}$-alkoxycarbonyl; optionally substituted $C_{3-8}$alkenyloxycarbonyl; optionally substituted $C_{1-4}$-alkylsulphonyl; optionally substituted phenylsulphonyl; optionally substituted aminocarbonyl; optionally substituted $C_{1-4}$-alkylaminocarbonyl; optionally substituted di($C_{1-4}$-alkyl)aminocarbonyl; optionally substituted phenyl and optionally substituted benzoyl;

X represents hydrogen; halogen; optionally substituted alkyl; optionally substituted aryl and optionally substituted heteroaryl;

Y represents -S- and >N—$R^1$ wherein $R^1$ is hydrogen or optionally substituted $C_{1-4}$-alkyl;

$R^3$ and $R^4$ independently represent H; $C_{1-4}$-alkyl; phenyl; $C_{4-8}$-cycloalkyl and $C_{1-4}$-alkyl substituted by a group selected from OH, CN, halogen, aryl, $C_{1-4}$-alkoxy, $C_{1-4}$-alkoxy-$C_{1-4}$-alkoxy, $C_{1-4}$-alkyl-CO-, $C_{1-4}$-alkoxy-CO-, $C_{1-4}$-alkoxy-COO-, $C_{1-4}$-alkyl-COO-, $C_{1-4}$alkoxy-$C_{1-4}$-alkoxy-CO-;

$R^5$ represents H; $C_{1-4}$-alkyl; cyano-$C_{1-4}$-alkyl; $C_{1-4}$-alkoxy; —NHCOT$^1$; wherein $T^1$ is $C_{1-4}$-alkyl or phenyl and $R^6$ represents H; $C_{1-4}$-alkyl or $C_{1-4}$-alkoxy.

Preferred optional substituents which may be present on groups represented by $R^2$, $R^3$, $R^4$, X and Y include cyano, hydroxy, halo, especially chloro, $C_{1-4}$-alkyl, $C_{1-4}$-alkoxy, $C_{1-4}$alkoxy-$C_{1-4}$-alkoxy, $C_{1-4}$-alkoxy-$C_{1-4}$-alkylcarbonyloxy, acetoxy and phenyl.

In the dyes of Formula I and Formula V preferred aryl radicals are phenyl and naphthyl and preferred heteroaryl radicals are pyridyl, thienyl, thiazolyl, pyrazolyl, imidazolyl and benzothiazolyl.

Preferred dyes of Formula V are those in which $R^2$ is $C_{1-6}$-alkoxycarbonyl, especially ethoxycarbonyl and $C_{1-4}$-alkoxy-$C_{1-4}$-alkoxycarbonyl, especially ethoxyethoxycarbonyl; X is chloro; Y is sulphur; $R^3$ and $R^4$ are independently selected from ethyl, butyl, 1-methylpropyl, 2-methylpropyl, acetoxyethyl and acetoxybutyl; $R^5$ is —H, methyl and acetylamino; and $R^6$ is —H.

The dyes of Formula I and Formula V have particularly good thermal properties giving rise to even prints on the receiver sheet, whose depth of shade is accurately proportional to the quantity of applied heat so that a true grey scale of coloration can be attained.

The dyes of Formula I and Formula V also have strong coloristic properties and good solubility in a wide range of solvents, especially those solvents which are widely used and accepted in the printing industry, for example, alkanols, such as i-propanol & butanol; aromatic hydrocarbons, such as toluene, and ketones such as MEK, MIBK and cyclohexanone and ethers such as tetrahydrofuran (THF). This produces inks (solvent plus dye and binder) which are stable and allow production of solution coated dyesheets. The latter are stable, being resistant to dye crystallisation or migration during prolonged storage.

The combination of strong coloristic properties and good solubility in the preferred solvents allows the achievement of deep, even shades on the receiver sheet. The receiver sheets according to the present invention have bright, strong and even magenta to cyan shades which are fast to both light and heat.

The Substrate

The substrate may be any convenient sheet material capable of withstanding the temperatures involved in DDTTP, up to 400° C. over a period of up to 20 milliseconds (msec) yet thin enough to transmit heat applied on one side through to the dye on the other side to effect transfer to a receiver sheet within such short periods, typically from 1-10 msec. Examples of suitable materials are paper, especially high quality paper of even thickness, such as capacitor paper, polyester, polyacrylate, polyamide, cellulosic and polyalkylene films, metallised forms thereof, including co-polymer and laminated films, especially laminates incorporating a polyester receptor layer on which the dye is deposited. Such laminates preferably comprise, a backcoat, on the opposite side of the laminate from the receptor layer, of a heat resistant material, such as a thermoseting resin, e.g a silicone, acrylate or polyurethane resin, to separate the heat source from the polyester and prevent melting of the latter during the thermal transfer printing operation. The thickness of the substrate may vary within wide limits depending upon its thermal characteristics but is preferably less than 20 um and more preferably below 10 um, and especially from 2 to 6 um

Preparation of Transfer Sheet

A transfer sheet may be prepared by applying a coating of the dye, dissolved or dispersed in suitable solvents and containing appropriate binders to form an ink, to the substrate such that a wet film of ink is produced on the surface of the substrate. The ink is then dried to produce the transfer sheet.

The DDTTP Process

According to a further feature of the present invention there is provided a transfer printing process which comprises contacting a transfer sheet coated with a dye of Formula I with a receiver sheet, so that the dye is in contact with the receiver sheet and selectively heating areas of the transfer sheet whereby dye in the heated areas of the transfer sheet may be selectively transferred to the receiver sheet.

The transfer sheet is preferably heated to a temperature from 250° C. to 400° C., more preferably above 300° C. and especially around 350° C., for a period of from 1 to 10 milliseconds while it is maintained with the coating in contact with the receiver sheet. The depth of shade of print on any area of the receiver sheet will vary with the time period for which the transfer sheet is heated while in contact with that area of the receiver sheet.

The Receiver Sheet

The receiver sheet conveniently comprises a polyester sheet material, especially a white polyester film, preferably of polyethylene terephthalate (PET). Although some dyes of Formula I are known for the coloration of textile materials made from PET, the coloration of textile materials, by dyeing or printing is carried out under such conditions of time and temperature that the dye can penetrate into the PET and become fixed therein. In thermal transfer printing, the time period is so short that penetration of the PET is much less effective and the substrate is preferably provided with a receptive layer, on the side to which the dye is applied, into which the dye more readily diffuses to form a stable image. Such a receptive layer, which may be applied by co-extrusion or solution coating techniques, may comprise a thin layer of a modified polyester or a different polymeric material which is more permeable to the dye than the PET substrate. While the nature of the receptive layer will affect to some extent the depth of shade and quality of the print obtained it has been found that the dyes of Formula I give particularly strong and good quality prints (e.g. fast to light, heat and storage) on any specific transfer or receiver sheet, compared with other dyes of similar structure which have been proposed for thermal transfer printing. The design of receiver and transfer sheets is discussed further in EP 133,011 and EP 133012.

The invention is further illustrated by the following examples in which all parts and percentages are by weight unless otherwise indicated.

Examples of specific dyes according to Formula V are shown in Table 1.

TABLE 1

| Dye | $R^2$ | X | Y | $R^3$ | $R^4$ | $R^5$ | $R^6$ |
|---|---|---|---|---|---|---|---|
| 1 | $C_2H_5OC_2H_4OCO$ | Cl | S | $C_2H_5$ | $C_2H_5$ | $NHCOCH_3$ | H |
| 2 | $C_2H_5OC_2H_4OCO$ | Cl | S | $C_2H_5$ | $C_2H_5$ | $CH_3$ | H |
| 3 | $C_2H_5OCO$ | Cl | S | $C_2H_5$ | $C_2H_5$ | $NHCOCH_3$ | H |
| 4 | $C_2H_5OCO$ | Cl | S | $C_2H_5$ | $C_2H_5$ | $CH_3$ | H |
| 5 | $C_2H_5OCO$ | Cl | S | $C_2H_5$ | $C_2H_5$ | $NHCOCH_3$ | H |
| 6 | $C_2H_5OCO$ | Cl | S | $C_2H_5$ | $C_4H_8OCOCH_3$ | $CH_3$ | H |
| 7 | $C_2H_5OCO$ | Cl | S | $C_2H_5$ | $C_2H_4OCOCH_3$ | $CH_3$ | H |
| 8 | $C_2H_5OCO$ | Cl | S | $C_2H_5$ | $CH_2CH(CH_3)_2$ | $CH_3$ | H |
| 9 | $C_2H_5OCO$ | Cl | S | $C_4H_9$ | $CH(CH_3)C_2H_5$ | $CH_3$ | H |
| 10 | $C_2H_5OCO$ | Cl | S | $C_2H_5$ | $CH(CH_3)C_2H_5$ | $CH_3$ | H |
| 11 | $C_2H_5OCO$ | Cl | S | $C_2H_5$ | $C_4H_9$ | $CH_3$ | H |

Ink 1

To a solution of 0.15 parts of Dye 1 in 4.85 parts of THF was added 5 parts of a 6% solution of EHEC in THF. The mixture was stirred for 30 minutes and the ink solution decanted from any insoluble residues before preparing the transfer sheets.

Inks 2 to 11

Inks 2 to 11 were prepared using Dyes 2 to 11 as shown in Table 1 using the same method as for Ink 1.

Transfer Sheet TS1

TS1 was prepared by applying Ink 1 to a sheet of 6 um thick polyethyleneterephthalate using a wire-wound metal Meyer-bar to produce a wet film of ink on the surface of the sheet. The ink was dried to produce TS1.

Transfer Sheets TS2–TS11

These were prepared as for TS1 using Dyes 2–11.

Printed Receiver Sheet RS1

A sample of TS1 was contacted with a receiver sheet, comprising a composite structure based in a white polyester base having a receptive coating layer on the side in contact with the printed surface of TS1. The receiver and transfer sheets were placed together on the drum of a transfer printing machine and passed over a matrix of closely-spaced pixels which were selectively heated in accordance with a pattern information signal to a temperature of >300° C. for periods from 1 to 10 msec, whereby a quantity of the dye, in proportion to the heating period, at the position on the transfer sheet in contact with a pixel while it was hot was transferred from the transfer sheet to the receiver sheet. After passage over the array of pixels the transfer sheet was separated from the receiver sheet.

Printed Receiver Sheets RS2 to RS11

These were prepared in the same way as RS1 using TS2 to TS11 in place of TS1.

Evaluation of Inks, Transfer Sheets and Printed Receiver Sheets

The stability of the ink and the quality of the print on the transfer sheet was assessed by visual inspection. An ink was considered stable if there was no precipitation over a period of two weeks at ambient temperature and a transfer sheet was considered stable if it remained substantially free from crystallisation for a similar period.

The quality of the printed impression on the receiver sheet was assessed in respect of reflected optical density (OD), of colour measured with a Sakura digital densitometer.

The results of these evaluations are shown in Table 2.

TABLE 2

| Receiver Sheet | OD |
|---|---|
| RS1 | 1.42 |
| RS2 | 1.66 |
| RS3 | 1.39 |
| RS4 | 0.79* |
| RS5 | 0.52* |
| RS6 | 1.86 |
| RS7 | 1.81 |
| RS8 | 2.07 |
| RS9 | 1.84 |
| RS10 | 2.05 |
| RS11 | 2.27 |

*The low value for OD arises because of low solubility of the dye in THF. This restricts the concentration of dye in the ink and therefore the amount of dye present on the transfer sheet.

I claim:

1. A thermal transfer printing sheet comprising a substrate having a coating comprising a binder and at least one azo dye of Formula I:

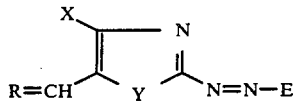

I wherein;

R is the residue of an active methylene compound;

X is hydrogen; halogen; optionally substituted alkyl; optionally substituted aryl or optionally substituted heteroaryl;

Y is -S- or a group of the formula >N—$R^1$ wherein $R^1$ represents hydrogen or an optionally substituted $C_{1-4}$-alkyl; and E is the residue of a coupling component.

2. A thermal transfer printing sheet according to claim 1 wherein R in the azo dyes is a group of Formula II:

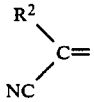

II wherein:

$R^2$ is cyano; acetyl; optionally substituted $C_{1-10}$-alkoxy-carbonyl; optionally substituted $C_{3-8}$-alkenyloxycarbonyl; $C_{1-4}$-alkylsulphonyl; optionally substituted phenylsulphonyl; optionally substituted aminocarbonyl; optionally substituted $C_{1-4}$-alkylamino- carbonyl; optionally substituted di($C_{1-4}$-alkyl)aminocarbonyl; optionally substituted phenyl or optionally substituted benzoyl.

3. A thermal transfer printing sheet according to claim 1 or claim 2 wherein E in the azo dyes is a group of Formula III:

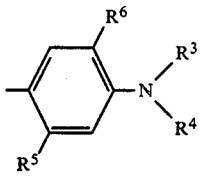

III wherein:

$R^3$ & $R^4$ are independently hydrogen; optionally substituted $C_{1-4}$-alkyl; $C_{4-8}$-cycloalkyl; $C_{3-4}$-alkenyl; phenyl-$C_{1-4}$-alkyl or phenyl;

$R^5$ is hydrogen; halogen; $C_{1-4}$-alkyl; $C_{1-4}$-alkoxy; $C_{1-4}$-alkylthio; $C_{1-4}$-alkylcarbonylamino; phenylcarbonylamino or $C_{1-4}$-alkylsulphonylamino; and $R^6$ is hydrogen; $C_{1-4}$-alkyl or $C_{1-4}$-alkoxy.

4. A thermal transfer printing sheet according to claim 1 or claim 2 wherein E in the azo dyes is a group of Formula III wherein:

$R^3$ & $R^4$ are independently hydrogen; $C_{1-4}$-alkyl; $C_{4-8}$-cycloalkyl; phenyl or $C_{1-4}$-alkyl substituted by a group selected from —OH, —CN, halogen, $C_{1-4}$-alkoxy, $C_{1-4}$-alkoxy-$C_{1-4}$-alkoxy, $C_{1-4}$-alkyl-CO-, $C_{1-4}$-alkoxy-CO-, $C_{1-4}$-alkyl-COO-, $C_{1-4}$-alkoxy-$C_{1-4}$-alkoxy-CO-, $C_{1-4}$-alkoxy-COO- and $C_{1-4}$-alkoxy-$C_{1-4}$-alkyl-COO-;

$R^5$ is hydrogen; $C_{1-4}$-alkyl; cyano-$C_{1-4}$-alkyl; $C_{1-4}$-alkoxy or —NHCOT$^1$ wherein T$^1$ is $C_{1-4}$-alkyl or phenyl; and $R^6$ is hydrogen.

5. A thermal transfer printing sheet according to claim 1 wherein the substrate is <20 um in thickness and is capable of withstanding temperatures up to 400° C. for up to 20 milliseconds.

6. A thermal transfer printing sheet according to claim 5 wherein the substrate is selected from the group consisting of (i) paper, (ii) polyester, polyacrylate, polyamide, cellulosic or polyalkylene films, (iii) metallized forms of polyester, polyacrylate, polyamide, cellulosic or polyalkylene films, (iv) co-polymer films and (v) laminates incorporating polyester receptor layers.

7. A thermal transfer printing sheet according to claim 1 wherein the binder is a polymeric material suitable for binding the dye to the substrate.

8. A thermal transfer printing sheet according to claim 7 wherein the binder is selected from ethyl hydroxycellulose, hydroxypropylcellulose, methylcellulose, ethylcellulose, cellulose acetate, cellulose acetate butyrate; starch; alkyd resins; polyvinylalcohol, polyvinyl butyral; polyvinyl pyrrolidone; polyacrylic acid, polymethyl-methacrylate, styreneacrylate co-polymers, polyester resins, polyamide resins, melamines; polyurea and polyurethane resins; polysiloxanes, epoxy resins, gum tragacanth and gum arabic.

9. A thermal transfer printing sheet according to claim 1 wherein the binder to dye ratio is from 1:1 to 4:1.

10. A process for the preparation of a thermal transfer printing sheet according to claim 1 which comprises applying an ink comprising 0.1 to 10% of the dye and 0.1 to 10% of the binder dissolved or dispersed in a solvent and evaporating the solvent to produce a coating of the dye and binder on the substrate.

11. A transfer printing sheet which comprises contacting a transfer sheet according to claim 1 with a receiver sheet so that the dye is in contact with the receiver sheet and selectively heating areas of the transfer sheet whereby dye in the heated areas of the transfer sheet may be transferred to the receiver sheet.

12. A transfer printing process according to claim 11 wherein the transfer sheet is heated to a temperature from 300° C. to 400° C. for a period of 1 to 20 milliseconds while in contact with the receiver sheet whereby the amount of dye transferred is proportional to the heating period.

13. A transfer printing process according to claim 12 wherein the receiver sheet is white polyester film.

14. A transfer printing process according to claim 11 or claim 12 wherein the receiver sheet is white polyester film.

15. A thermal transfer printing sheet comprising a substrate having a coating comprising a binder and at least one azo dye of the Formula V:

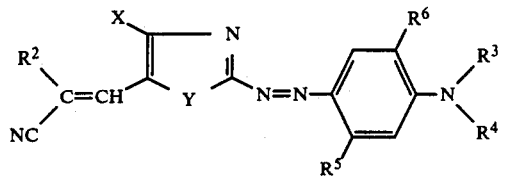

V wherein:

$R^2$ represents cyano; acetyl and optionally substituted $C_{1-6}$-alkoxycarbonyl; optionally substituted $C_{3-8}$alkenyloxycarbonyl; optionally substituted $C_{1-4}$-alkylsulphonyl; optionally substituted phenylsulphonyl; optionally substituted aminocarbonyl; optionally substituted $C_{1-4}$-alkylaminocarbonyl; optionally substituted di($C_{1-4}$-alkyl)aminocarbonyl; optionally substituted phenyl and optionally substituted benzoyl;

X represents hydrogen; halogen; optionally substituted alkyl; optionally substituted aryl and optionally substituted heteroaryl;

Y represents -S- and >N—R$^1$ wherein R$^1$ is hydrogen or optionally substituted $C_{1-4}$-alkyl;

$R^3$ and $R^4$ independently represent H; $C_{1-4}$-alkyl; phenyl; $C_{4-8}$-cycloalkyl and $C_{1-4}$alkyl substituted by a group dispersed in a solvent and evaporating the solvent to produce a coating of the dye and binder on the substrate.

16. A thermal transfer printing sheet according to claim 15 wherein in the azo dye of Formula V:

$R^2$ is $C_{1-6}$-alkoxycarbonyl or $C_{1-4}$-alkoxy-$C_{1-4}$-alkoxycarbonyl;

X is chloro;

Y is sulphur;

$R^3$ & $R^4$ independently are $C_{1-4}$-alkyl or $C_{1-4}$-alkoxy-CO-$C_{1-4}$-alkyl;

$R^5$ is hydrogen; $C_{1-4}$-alkyl or —NHCOT$^1$ wherein T$^1$ is $C_{1-4}$-alkyl or phenyl; and $R^6$ is hydrogen.

17. A thermal transfer printing sheet according to claim 15 wherein in the azo dye of Formula V:

$R^2$ is ethoxycarbonyl or ethoxyethoxycarbonyl;

X is chloro;

Y is sulphur;

$R^3$ & $R^4$ independently are ethyl, butyl, 1-methylpropyl, 2-methylpropyl, acetoxyethyl or acetoxybutyl;

$R^5$ is methyl or acetylamino; and $R^6$ is hydrogen.

* * * * *